US007035555B1

(12) United States Patent
Young

(10) Patent No.: US 7,035,555 B1
(45) Date of Patent: Apr. 25, 2006

(54) APPARATUS AND METHOD FOR DETECTING CONSUMABLE PRODUCT ENGAGEMENT IN A PRINTING DEVICE

(75) Inventor: Jerry A Young, Nampa, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/013,602

(22) Filed: Dec. 15, 2004

Related U.S. Application Data

(60) Provisional application No. 60/616,881, filed on Oct. 6, 2004.

(51) Int. Cl.
*G03G 15/00* (2006.01)

(52) U.S. Cl. ..... 399/13; 399/25

(58) Field of Classification Search ..... 399/13, 399/24, 25, 27, 36; 324/635
See application file for complete search history.

(56) References Cited

U.S. PATENT DOCUMENTS

| | | | | |
|---|---|---|---|---|
| 5,184,181 | A | 2/1993 | Kurando et al. | |
| 5,289,242 | A | 2/1994 | Christensen et al. | |
| 5,842,800 | A | 12/1998 | Bailey et al. | |
| 5,893,006 | A | 4/1999 | Kanno et al. | |
| 6,064,842 | A * | 5/2000 | Takeuchi et al. | 399/111 |
| 6,154,619 | A | 11/2000 | Boockholdt et al. | |
| 6,731,119 | B1 * | 5/2004 | Haffner et al. | 324/635 |
| 6,744,014 | B1 * | 6/2004 | Tanamachi et al. | 219/216 |
| 6,766,128 | B1 * | 7/2004 | Jaskowiak | 399/164 |
| 6,892,033 | B1 * | 5/2005 | Sunada et al. | 399/13 |
| 2004/0253008 | A1 * | 12/2004 | Chapman et al. | 399/13 |

* cited by examiner

*Primary Examiner*—Arthur T. Grimley
*Assistant Examiner*—Joseph S. Wong

(57) ABSTRACT

An apparatus for detecting the engagement of a consumable in a printing device includes a consumable cartridge having a rotatable member carried by the cartridge, and a drive member configured to engage and rotate the rotatable member. A proximity sensor positioned adjacent an engagement interface between the rotatable member and the drive member generates an output signal variable with the distance between the rotatable member and the drive member. Data that is stored in memory provides at least one predetermined set of characteristic values of the proximity sensor output signal versus distance between the rotatable member and the drive member, where the at least one characteristic value of the proximity sensor output signal is indicative of engagement between the rotatable member and the drive member. Processing circuitry coupled to the proximity sensor and the memory determines when the rotatable member and drive member are engaged.

17 Claims, 3 Drawing Sheets

APPARATUS AND METHOD FOR DETECTING CONSUMABLE PRODUCT ENGAGEMENT IN A PRINTING DEVICE

CLAIM OF PRIORITY

This application claims the benefit of U.S. Provisional Application No. 60/616,881, filed on Oct. 6, 2004, and titled APPARATUS AND METHOD FOR DETECTING CONSUMABLE PRODUCT ENGAGEMENT IN A PRINTING DEVICE.

BACKGROUND

A number of different printing devices utilize replaceable consumable products such as toner cartridges. For example, printing devices, such as, laser printers, multiple function peripheral devices (MFPs), copy machines, and the like have been designed with replaceable toner cartridges that enable a user to quickly and efficiently replenish toner when the device exhausts toner from an existing cartridge. Many consumable cartridges carry one or more elements that rotate within the cartridge, such as photoconductive drums, developer rollers, and the like. Such consumable cartridges typically have a rotatable member that is accessible from the outside of the cartridge and which is configured to engage a drive member carried by the printing device. The drive member rotates the rotatable member, which in turn drives the other rotating elements within the cartridge. Successful operation of the printing device depends upon the drive member engaging the rotatable member.

One problem associated with the use of some replaceable toner cartridges results when the drive member of the printing device does not successfully or sufficiently engage the rotatable member of the cartridge. Failure to engage the cartridge may result from several causes. For example, the cartridge may not be properly or fully inserted into the printing device due to a user's unfamiliarity with how to replace the cartridge, engagement may be blocked by debris, or biasing means intended to urge engagement may weaken or fail over time, to name a few possible causes. In many instances, the cartridge may appear to be fully inserted into the printing device, and the failure to engage may not be readily apparent to the user, other than the printing device's inability to properly operate.

Failure of the drive member to engage the rotatable member is typically simple to rectify. However, because an engagement failure is often difficult to identify by the user, the user often resorts to making a service call for repair of the printing device. The user is then required to endure a delay in using the printing device while the service call is answered. Such delay would be unnecessary if the engagement failure could be readily identified by the user.

DESCRIPTION

Figure 1:
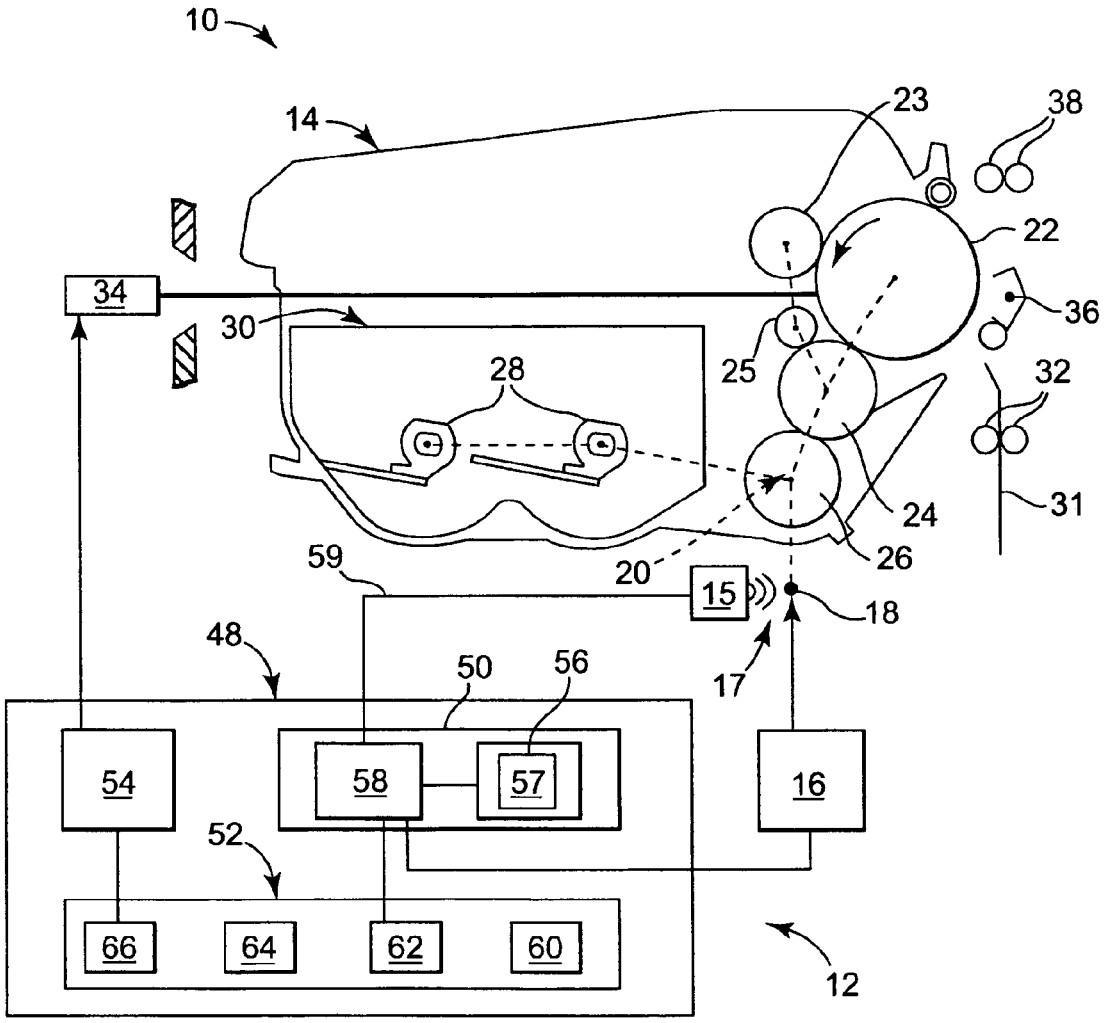
FIG. 1 is a schematic and partial sectional view of an electrophotographic printing device utilizing an apparatus for detecting engagement between a toner cartridge and the printing device according to an exemplary embodiment.

FIG. 1 shows an exemplary peripheral device in the form of printer 10 incorporating an apparatus 12 for detecting engagement of a consumable cartridge 14 in printer 10. Detection apparatus 12 includes a proximity sensor 15 positioned adjacent an engagement interface 17 between a drive member 16 on printer 10 and a rotatable member 18 on consumable cartridge 14, and an electronics assembly 48. Via a gear train 20 on consumable cartridge 14, rotation of rotatable member 18 causes co-rotation of a photoconductive (PC) drum 22, a charge roller 23, a developer roller 24, a toner charge roller 25, a toner feed roller 26, and a plurality of mixing paddles 28 during a printing operation. Mixing paddles 28 are positioned within a toner supply reservoir housing 30 in which toner is contained for delivery via toner feed roller 26 and developer roller 24 to the surface of photoconductive drum 22. According to one construction, photoconductive (PC) drum 22 is an organic photoconductive (OPC) drum. However, it is understood that other forms of photoconductor drums can be utilized.

As shown in FIG. 1, cartridge 14 is a consumable cartridge configured in the form of a toner cartridge. However, it is understood that the illustrated embodiment of consumable cartridge 14 is exemplary only, and other embodiments of consumable cartridges 14 may have other arrangements of rollers and gear trains. Further, it is understood that consumable cartridge 14 can also be a support structure that carries a photoconductive drum, a housing that carries toner in which is provided at least one mixing paddle, or any other consumable having a rotatable member that is engaged and driven in rotation by drive member 16 of printer 10.

Although this description makes reference to a traditional toner cartridge for use in a printer or other like printing device, it is understood that the apparatuses and methods can be implemented on developer units, within color toner units, and other consumable cartridges wherein not all operating components are carried within the cartridge, but wherein a rotatable member carried by the cartridge is placed into rotatable engagement with a drive member of the associated device. Therefore, the apparatuses and methods described herein can be useful in any consumable component having a rotatable member or the like that is provided engagement with a drive member.

As shown in FIG. 1, a sheet of paper 31 is delivered via a plurality of supply rollers 32 for delivery against photoconductor drum 22 where an image is transferred thereon. In operation, printer 10 performs a complete cycle of image-forming operations with each complete revolution of photoconductive drum 22. Beginning with a process initiation point (not shown) on drum 22, a charging device such as charge roller 23 electrostatically charges the photoconductive drum 22. Charging devices other than charge roller 23 may alternately be used, such as a charging corona, a charge wire, or other known charging device. Subsequently, an exposure device 34, such as a solid state laser and an imaging optics array, exposes the photoconductive drum 22 with an image light pattern. Exposure of the photoconductive drum 22 results in selective discharge of the previously uniformly charged area created in the previous step, resulting in an electrostatic latent image on photoconductive drum 22. Toner cartridge 14 then delivers electrostatically charged powder toner particles (either black or colored) to the photoconductive surface on drum 22, thereby developing the latent image on photoconductor on drum 22 with the toner particles selectively adhered to appropriately charged regions. A discharge corona 36 charges the back side of paper 31 such that toner is transferred from the photoconductive drum 22 onto paper 31, where paper 31 and photoconductive drum 22 contact in the region of charging corona 36. Subsequently, a fusing station comprising a pair of hot fusing rollers 38 thermally fuses the transferred powder toner onto paper 31.

In operation, toner feed roller 26 and developer roller 24 transfer toner from the toner bath within housing 30 onto photoconductive drum 22. Typically, a dry toner is used which consists of fine thermal plastic particles that are impregnated with a ferromagnetic material such as iron. Developer roller 24 is electrically biased so as to repel the charged toner onto the latent image on photoconductive drum 22. In this manner, toner is transferred onto photoconductive drum 22 so as to form a pattern thereon which duplicates an latent image delivered via exposure device 34.

As shown in FIG. 1, electronics assembly 48 includes control circuitry 50, formatter 52, and controller 54 for exposure device 34. Typically, control circuitry 50 comprises a control circuitry board containing electronics mounted thereon. Likewise, formatter 52 typically comprises a formatter board containing electronics mounted thereon. Control circuitry 50 includes a data storage device (or programmable memory) 56 and a microprocessor (or processing circuitry) 58. Likewise, formatter 52 includes programmable memory 60, a microprocessor (or processing circuitry) 62, a variable frequency clock 64, and a page buffer 66.

Figure 2:
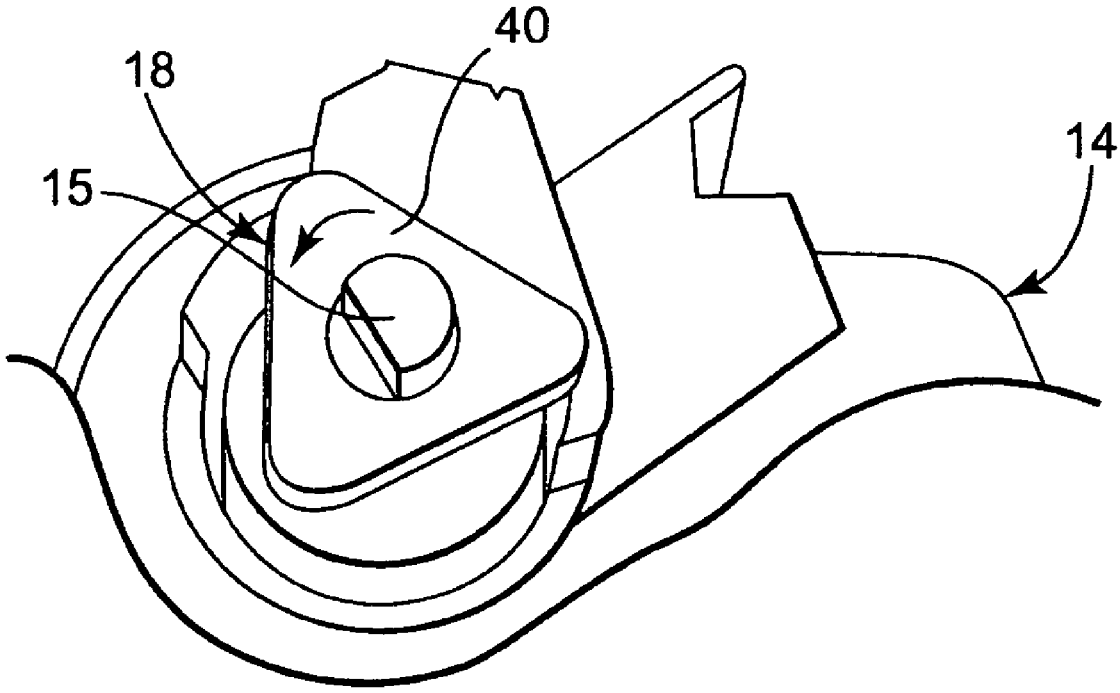
FIG. 2 is an enlarged schematic perspective view of the toner cartridge of FIG. 1, illustrating a proximity sensor coupled to a rotatable member carried by the cartridge.
Figure 3:
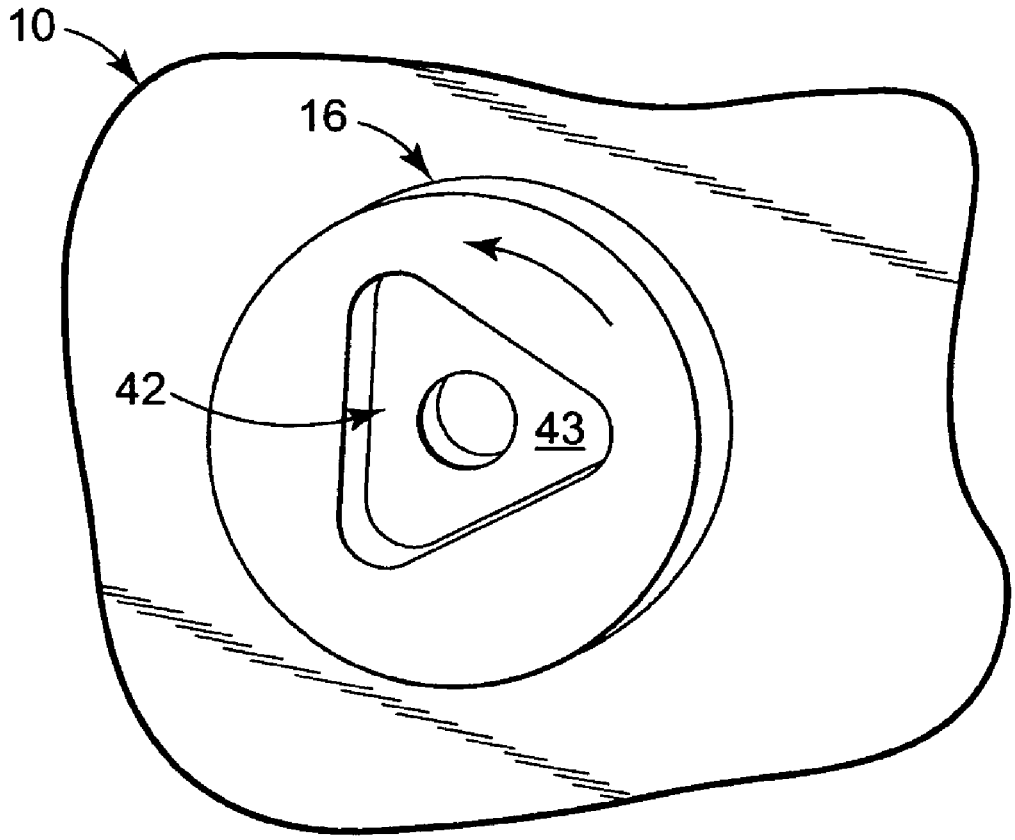
FIG. 3 is an enlarged schematic perspective view of the printing device of FIG. 1, illustrating a drive member carried by the printing device.

FIG. 2 illustrates an exemplary embodiment of a consumable cartridge 14 carrying a rotatable member 18, while FIG. 3 illustrates an exemplary embodiment of a drive member 16 on printer 10. In the exemplary embodiment, rotatable member 18 is a spindle extending from photoconductive drum 22 (not shown), and drive member 16 is a rotating clutch configured to engage the spindle and drive the spindle in rotation. An end 40 of rotatable member 18 and drive member 16 of printer 10 have complimentary engaging shapes, such that projecting end 40 of rotatable member 18 enters recessed portion 42 of drive member 16 when cartridge 14 is properly inserted into printer 10. Engagement between drive member 16 and rotatable member 18 may be aided, for example, by a biasing force urging the projecting end 40 into recessed portion 42. The projecting end 40 of rotatable member 18 and recessed portion 42 of drive member 16 are illustrated as having generally triangular complimentary engaging shapes. However, it is understood that other complimentary engaging shapes may be used, and further, that other engagement means may be utilized between drive member 16 and rotatable member 18. Although rotatable member 18 is illustrated as a spindle extending from photoconductive drum 22, it is understood that the rotatable member 18 could alternately extend from any of the rotating members of cartridge 14, including charge roller 23, developer roller 24, toner charge roller 25, toner feed roller 26, or one of the plurality of mixing paddles 28. Even further optionally, the rotatable member 18 could extend from any rotating element of gear train 20.

As seen in FIG. 2, a proximity sensor 15 is positioned on end 40 of rotatable member 18. Proximity sensor 15 is a non-contact proximity sensor, and is operative to generate an output signal that varies with the distance or spacing between the end 40 of rotatable member 18 and the bottom 43 of recessed portion 42 in drive member 16. Using the output signal from proximity sensor 15, it can be determined when end 40 is sufficiently engaged with recessed portion 42 such that drive member 16 can successfully drive rotatable member 18 in rotation. Although end 40 does not need to be fully inserted into recessed portion 42, if end 40 is not sufficiently engaged with recessed portion 42 (i.e., end 40 is not inserted far enough into recessed portion 42), rotation of drive member 16 will not result in rotation of rotatable member 18. When projecting end 40 is inserted far enough into recessed portion 42, drive member 16 may be rotated to drive the rotatable member 18. Insufficient engagement between drive member 16 and rotatable member 18 may be caused, for example, by an insufficient biasing force urging projecting end 40 into recessed portion 42, by debris obstructing the movement of end 40 into recessed portion 42, or improper insertion of the cartridge 14 by a user. Although proximity sensor 15 is illustrated as positioned on the end 40 of rotatable member 18, it is understood that proximity sensor 15 may optionally be positioned on the bottom 43 of recessed portion 42 of drive member 16. Even further optionally, proximity sensor 15 may be positioned anywhere on cartridge 14 or printer 10 that is indicative of the distance between drive member 16 and rotatable member 18.

Typically, the end 40 of rotatable member 18 needs to be within a certain distance from the bottom 43 of the recessed portion 42 for the drive member to successfully rotate the rotatable member 18. The drive member 16 is typically capable of successfully engaging and rotating the rotatable member 18 over a range of distances, from no distance between end 40 and bottom 43 (i.e., full insertion) to a maximum distance, where the maximum distance is dependent upon the particular configuration of the engagement means.

Proximity sensor 15 is a non-contacting proximity sensor, as are known in the art, that generates an output signal variable with distance between the sensor 15 and a detectable object or target. In certain exemplary embodiments, proximity sensor 15 is an inductive proximity sensor that measures changes in inductance as a detectable object moves into the sensor's field of detection. In other exemplary embodiments, proximity sensor 15 is a capacitive proximity sensor that measures changes in capacitance as a detectable object moves into the sensor's field of detection.

In operation, when cartridge 14 is inserted into printer 10, the proximity sensor 15 generates an output signal variable with the distance between the end 40 of rotatable member 18 and the bottom 43 of recessed portion 42 of drive member 16. Using a characteristic proximity sensor 15, cartridge 14, and printer 10, a characteristic output signal can be determined for the continuum of distances between the end 40 of rotatable member 18 and the bottom 43 of recessed portion 42 of drive member 16 as cartridge 14 is inserted into printer 10. More particularly, the characteristic value of the output signal when the drive member 16 and rotatable member 18 are sufficiently engaged can be determined. In one embodiment, a target value of the output signal is determined, where the target value is indicative that the operating state of the cartridge 14 has changed from a disengaged state to an engaged state, or visa versa.

Referring to FIG. 1, processing circuitry 58 is coupled with the proximity sensor 15 via a communication link 59 and receives the generated output signal from proximity sensor 15. The processing circuitry 58 also accesses a look-up table 57 in data storage device 56. The look-up table 57 includes the previously determined characteristic output signal versus distance between drive member 16 and rotatable member 18. In one embodiment, the look-up table 57 includes at least the predetermined characteristic value of the output signal indicative of sufficient engagement between the rotatable member 18 and the drive member 16.

In another embodiment, the look-up table 57 includes the target value of the output signal indicative of a change of operating state of the cartridge 14.

The processing circuitry 58 compares the generated output signal from sensor 15 with the predetermined characteristic output signal from look-up table 57. When the generated output signal corresponds to the predetermined characteristic output signal, the processing circuitry determines that the drive member 16 and the rotatable member 18 are sufficiently engaged for continued printer operations. If the drive member 16 and the rotatable member 18 are sufficiently engaged, processing circuitry continues printing operations, including the rotation of drive member 16. If the drive member 16 and the rotatable member 18 are not sufficiently engaged, further printer operations are halted, and the electronics assembly 48 may signal the user of such insufficient engagement so the user may remedy the problem.

Although exemplary embodiments have been illustrated and described herein for purposes of description, it will be appreciated by those of ordinary skill in the art that a wide variety of alternate and/or equivalent implementations may be substituted for the specific embodiments shown and described without departing from the spirit and scope of the present invention. This application is intended to cover any adaptations or variations of the exemplary embodiments discussed herein. Therefore, it is manifestly intended that the foregoing discussion is illustrative only, and the invention is limited and defined only by the following claims and the equivalents thereof.

What is claimed is:

1. An apparatus for detecting the engagement of a consumable in a printing device, comprising:

a consumable cartridge having a rotatable member carried by the cartridge;

a drive member configured to engage and rotate the rotatable member;

a proximity sensor adjacent an engagement interface between the rotatable member and the drive member, the proximity sensor operative to generate an output signal variable with distance between the rotatable member and the drive member;

memory including data configured to store at least one predetermined set of characteristic values of the proximity sensor output signal versus distance between the rotatable member and the drive member, wherein the at least one characteristic value of the proximity sensor output signal is indicative of engagement between the rotatable member and the drive member; and processing circuitry coupled to the proximity sensor and the memory and operative to determine when the generated proximity sensor output signal corresponds to the at least one characteristic value of the output signal.

2. The apparatus of claim 1, wherein the proximity sensor is operative to measure inductance, and wherein the inductance is variable with distance between the rotatable member and the drive member.

3. The apparatus of claim 1, wherein the proximity sensor is operative to measure capacitance, and wherein the capacitance is variable with distance between the rotatable member and the drive member.

4. The apparatus of claim 1, wherein the consumable cartridge comprises a toner cartridge, the rotatable member comprises a spindle, the drive member comprises a clutch for engaging and rotating the spindle over a range of spindle to clutch distances, and the at least one characteristic value of the proximity sensor output signal is indicative of a maximum spindle to clutch distance at which the clutch can engage and rotate the spindle.

5. The apparatus of claim 1, wherein the proximity sensor is positioned on the rotatable member.

6. The apparatus of claim 1, wherein the proximity sensor is positioned on the drive member.

7. The apparatus of claim 1, wherein the proximity sensor is a non-contact sensor.

8. The apparatus of claim 1, wherein the data is included in a look-up table.

9. An apparatus for detecting the operating state of a toner cartridge into a printing device, comprising:

a drive clutch configured to engage an end of a spindle of a toner cartridge, the drive clutch operative to rotate the spindle;

a non-contact proximity sensor adjacent the end of the spindle and operative to generate an output signal variable with distance between the end of the spindle and the drive clutch;

a data storage device operative to store at least one target value of the sensor output signal representative of distance between the end of the spindle and the drive clutch and indicative of a change in operating state of the toner cartridge; and processing circuitry communicating with the proximity sensor and the data storage device and operative to compare the generated sensor output signal and the target value of the sensor output signal to determine when a change in operating state of the toner cartridge has occurred.

10. The apparatus of claim 9, wherein the at least one target value comprises a look-up table containing data representative of sensor output signal versus distance between the end of the spindle and the drive clutch when inserting the toner cartridge in the printing device.

11. The apparatus of claim 9, wherein the at least one target value is indicative of an engagement state of the toner cartridge, and wherein at least two engagement states are provided for the toner cartridge including an engaged state and a disengaged state.

12. A method of determining the engagement state of a replaceable cartridge in a printing device, comprising:

providing a drive member configured to engage and drive in rotation a rotatable member of the cartridge, and a non-contact proximity sensor adjacent an engagement interface of the drive member and the rotatable member;

generating an output signal with the proximity sensor, the output signal having a value variable with distance between the drive member and the rotatable member;

detecting the output signal value from the proximity sensor;

comparing the detected output signal value with a predetermined output signal value, wherein the predetermined output signal value is indicative of an engagement state of the cartridge; and determining the engagement state of the cartridge based upon the compared detected output signal value and predetermined output signal value.

13. The method of claim 12, wherein the non-contact proximity sensor is operative to measure inductance, and further comprising measuring changes in inductance as the distance between the drive member and the rotatable member changes, wherein generating an output signal comprises varying the value of the output signal with changes in the measured inductance.

14. The method of claim 12, wherein the non-contact proximity sensor is operative to measure capacitance, and further comprising measuring changes in capacitance as the distance between the drive member and the rotatable member changes, wherein generating an output signal comprises varying the value of the output signal with changes in the measured capacitance.

15. A replaceable toner cartridge for a printing device, comprising:

a rotatable member having an end configured for engagement with a drive member of a printing device;

a non-contact proximity sensor positioned at the end of the rotatable member, the proximity sensor operative to generate an output signal variable with distance between the sensor and the drive member of the printing device; and a communication link for providing the output signal to the printing device.

16. The cartridge of claim 15, wherein the non-contact proximity sensor is operative to measure changes in inductance as the distance between the sensor and the drive member changes, and generates an output signal indicative of the distance between the sensor and the drive member.

17. The cartridge of claim 15, wherein the non-contact proximity sensor is operative to measure changes in capacitance as the distance between the sensor and the drive member changes, and generates an output signal indicative of the distance between the sensor and the drive member.

* * * * *